US006766759B2

(12) United States Patent
Eck et al.

(10) Patent No.: US 6,766,759 B2
(45) Date of Patent: Jul. 27, 2004

(54) WATERCRAFT WITH FLEXIBLE SEATING CONFIGURATIONS

(75) Inventors: Richard E. Eck, Mount Vernon, IL (US); Martin Aubé, St-Bruno-de-Montarville (CA); David Kalhok, Marion, IL (US)

(73) Assignee: Bombardier Recreational Products Inc., St-Bruno (CA)

( * ) Notice: Subject to any disclaimer, the term of this patent is extended or adjusted under 35 U.S.C. 154(b) by 0 days.

(21) Appl. No.: 10/206,992

(22) Filed: Jul. 30, 2002

(65) Prior Publication Data

US 2003/0000449 A1 Jan. 2, 2003

Related U.S. Application Data

(63) Continuation-in-part of application No. 09/635,262, filed on Aug. 9, 2000, now Pat. No. 6,672,240.

(60) Provisional application No. 60/308,817, filed on Aug. 1, 2001, and provisional application No. 60/168,676, filed on Dec. 3, 1999.

(30) Foreign Application Priority Data

Aug. 9, 1999 (CA) ..... 2279804

(51) Int. Cl.[7] ..... B63B 17/00

(52) U.S. Cl. ..... 114/363

(58) Field of Search ..... 114/363

(56) References Cited

U.S. PATENT DOCUMENTS

| | | | | |
|---|---|---|---|---|
| 2,713,841 A | | 7/1955 | Forbes | |
| 2,766,714 A | | 10/1956 | Hammers | |
| 3,290,706 A | | 12/1966 | Hale | |
| 3,379,471 A | * | 4/1968 | Dalziel | 297/92 |
| 3,428,976 A | | 2/1969 | Robinson | |
| 3,473,176 A | * | 10/1969 | Taylor | 114/363 |
| 3,811,143 A | | 5/1974 | Page | |
| 3,823,431 A | | 7/1974 | Miller | |
| 3,949,700 A | | 4/1976 | Baroody | |
| 4,033,280 A | | 7/1977 | Wood et al. | |
| 4,040,693 A | | 8/1977 | Peterson et al. | |
| 4,742,795 A | | 5/1988 | DePrey et al. | |
| 4,883,016 A | | 11/1989 | Larson | |
| 4,945,853 A | * | 8/1990 | Lathers | 114/363 |
| 4,957,056 A | | 9/1990 | Martin | |
| 5,029,348 A | | 7/1991 | Boren | |
| 5,095,843 A | | 3/1992 | Kobayashi | |
| 5,123,372 A | | 6/1992 | Kobahashi et al. | |
| 5,136,963 A | | 8/1992 | Zuzik | |
| 5,143,013 A | | 9/1992 | Huebner | |
| 5,150,663 A | | 9/1992 | Kobayashi | |
| 5,237,950 A | | 8/1993 | Abe et al. | |
| 5,331,917 A | | 7/1994 | Magers | |
| 5,349,919 A | | 9/1994 | Douglass | |
| 5,355,826 A | | 10/1994 | Hattori et al. | |
| 5,366,028 A | | 11/1994 | Kobayashi | |
| 5,416,670 A | | 5/1995 | Authier | |
| 5,490,474 A | | 2/1996 | Ikeda | |
| 5,497,724 A | * | 3/1996 | Brown et al. | 114/343 |
| 5,537,948 A | | 7/1996 | Kobayashi | |
| 5,566,637 A | | 10/1996 | Benza | |
| 5,572,944 A | | 11/1996 | Slikkers et al. | |
| 5,915,329 A | | 6/1999 | Watkins et al. | |
| 6,062,922 A | | 5/2000 | Nanami | |
| 6,071,156 A | | 6/2000 | Platzer et al. | |
| 6,168,481 B1 | | 1/2001 | Mardikian | |
| 6,236,826 B1 | | 5/2001 | Kurz et al. | |

* cited by examiner

*Primary Examiner*—Sherman Basinger
(74) *Attorney, Agent, or Firm*—BRP-Legal Services

(57) ABSTRACT

A watercraft with flexible seating configurations is disclosed. A driver's seat that accommodates a driver and a rider, and a passenger's seat that accommodates at least two riders may be configured in a lockable driving position or a relaxing position. In the driving position, the seats are substantially contiguous. In the relaxing position, the seats form a substantially contiguous seating module with a rear passenger bench.

11 Claims, 9 Drawing Sheets

WATERCRAFT WITH FLEXIBLE SEATING CONFIGURATIONS

CROSS-REFERENCE

This application is a continuation-in-part of U.S. Non-provisional Patent application Ser. No. 09/635,262, filed on Aug. 9, 2000, now U.S. Pat. No. 6,672,240, which is incorporated herein by reference. This application also claims the benefit of U.S. Provisional Patent Application No. 60/168,676, filed Dec. 3, 1999, and Canadian Patent Application No. 2,279,804, filed Aug. 9, 1999, both of which are incorporated herein by reference. The parent application (09/635,262) relies on these two applications for priority. In addition, this application relies for priority on U.S. provisional patent application Serial No. 60/308,817, filed on Aug. 1, 2001, the contents of which are incorporated herein by reference.

FIELD OF THE INVENTION

This invention relates to watercraft and more particularly to flexible seating configurations in a watercraft.

DESCRIPTION OF THE RELATED ART

Various types of watercraft exist, each being suited for different types of activities. For example, one type of boat, the pontoon-type watercraft, is usually equipped with an outboard motor, typically operates at slower speeds, and generally offers a more relaxed ride.

Conventionally, chairs and tables are arranged on the deck of the pontoon-type watercraft for cruising and for accommodating a variety of other aquatic activities in space and comfort. Since most, if not all, of the chairs located on the deck of a pontoon boat are not physically attached to the boat, the chairs can be arranged in many different configurations, providing for a high level of flexibility.

Other types of watercraft, such as sport boats, are designed for higher speeds and sportier handling. In contrast to pontoon boats, sport boats typically are designed with specific deck configurations where the seats are fixedly positioned to provide a safe and comfortable ride.

In a conventional sport boat, the seats are fixed such that riders cannot choose a seating configuration. While the boat is moving, particularly at higher speeds, it is desirable for riders to face forward. Therefore, in a conventional sport boat, the seats are typically fixed such that riders will necessarily face forward at all times.

However, once the boat is anchored, it is often more desirable for the riders to face one another, so that it is easier to engage in conversation. Also, it is desirable for the riders to be able to move about the boat with greater ease. This is often hindered by the design of conventional sport boats where the seats are often fixed in a forward-only position.

While pontoon-type boats and sport boats do not define the entire universe of possible options, a significant gap exists between these two types of watercraft.

Accordingly, a need has developed for a watercraft that can provide greater flexibility in seating configurations for riders on deck (like the pontoon boat), while also being capable of accommodating riders at greater speeds (like the sport boat).

SUMMARY OF THE INVENTION

It is, therefore, an object of the present invention to provide a watercraft with a powered hull and a flexible seating configuration.

One embodiment of the present invention provides at least one seat configured for accommodating at least one rider that is selectively switchable between a driving position and at least one relaxing position.

A further object of the present invention is to provide a pair of passenger seats that are selectively switchable between a driving position and at least one relaxing position. When the pair of seats are in the driving position, the seats are substantially contiguous.

A further object of the present invention is to provide a rear passenger bench such that when the pair of seats are in a relaxing position, they form a substantially contiguous seating module with the passenger bench.

Another embodiment of the present invention provides a powered hull, at least one seat for accommodating a single rider, and a rear passenger bench, such that when the single passenger seat is in a relaxing position, it forms a substantially contiguous seating module with the passenger bench.

Another embodiment of the present invention provides a powered hull, a pair of seats for accommodating one rider each, and a rear passenger bench, such that when the pair of passenger seats are in a relaxing position, they form a substantially contiguous seating module with the passenger bench.

BRIEF DESCRIPTION OF THE DRAWINGS

The accompanying drawings, which are incorporated in and constitute a part of the specification, illustrate embodiments of the invention and, together with the general description given above and the detailed description of the embodiments given below, serve to explain the principles of the present invention. In the drawings.

DETAILED DESCRIPTION OF THE PREFERRED EMBODIMENTS

Throughout the description of the several embodiments of the present invention, reference will be made to various elements, the construction of which is readily known to those skilled in the art. Accordingly, an exhaustive description of each and every component is not provided, only a description of those elements required for an understanding of the present invention.

Figure 1:
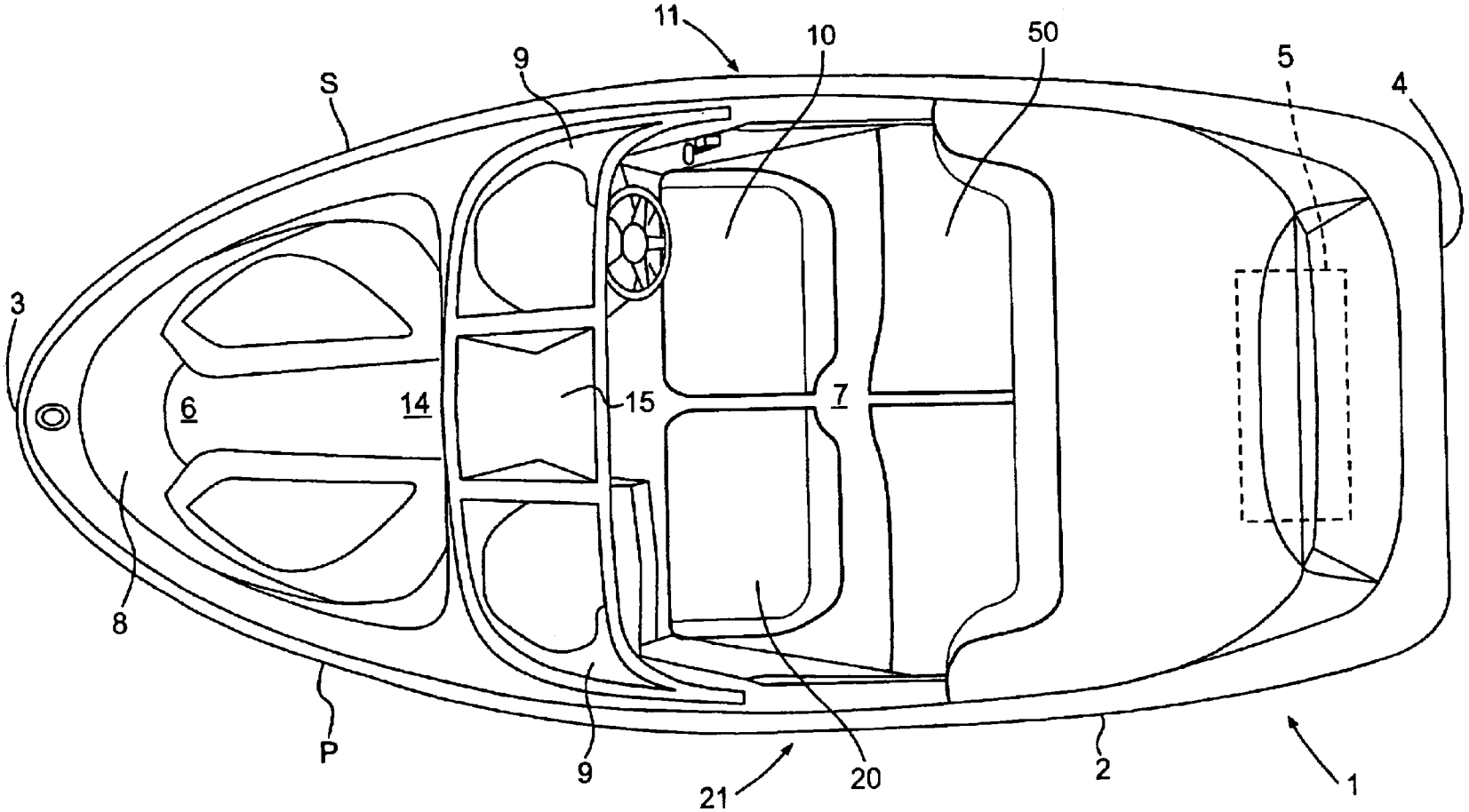
FIG. 1 is a top view of the deck layout of a first embodiment of the watercraft of the present invention with the driver's and passenger's seats in the driving position.

FIG. 1 is a top view of a watercraft 1 of the present invention. In the preferred embodiment, the watercraft 1 is a jet boat that includes a powered hull 2. The watercraft illustrated in FIG. 1 is a sport boat. The details of the sport boat have been omitted because they are not relevant to the present invention. As those of ordinary skill in the art will appreciate after reading the description set forth below, the present invention may be employed on any watercraft, regardless of style, size or propulsion type.

In the watercraft 1 depicted in the figures, the hull 2 includes a bow 3 and a stern 4. An engine 5 is disposed at the stem 4 of the watercraft 1. The engine 5 is connected to a propulsion unit (not shown) that provides the motive force for the watercraft 1. Preferably, the engine 5 is either a two or four stroke internal combustion engine. However, other engine types may be used without deviating from the scope of the present invention. In addition, the propulsion unit preferably is a jet pump arranged at the stern 4 of the watercraft 1. As would be appreciated by those skilled in the art, however, alternative propulsion units, such as a propeller, may be substituted therefor without deviating from the scope of the present invention.

Generally, the watercraft 1 depicted includes a forward passenger area 6 and a rearward passenger area 7. The forward passenger area 6 is disposed in the bow 3 of the watercraft 1 and is provided with a seating arrangement 8, which, in the case of the watercraft 1 illustrated, includes two forwardly-facing seats, disposed side by side. The seating arrangement in the rear passenger area 7 will be described in greater detail below.

The forward passenger area 6 is separated from the rearward passenger area 7 by a windshield 9 that extends from the port side P to the starboard side S of the watercraft 1. To permit riders to move about the watercraft 1 between the forward passenger area 6 and the rearward passenger area 7, a passageway 14 is provided between the two areas 6, 7.

A hinged window section 15 is disposed in the passageway 14. The window section 15 is shown in the closed position in FIG. 1. The closed position is preferred when the watercraft 1 is underway because the window section 15 completes the wind screen provided by windshield 9. When the watercraft 1 is anchored, the window section 15 may be opened to permit riders to move freely between the forward passenger area 6 and the rearward passenger area 7 (through passageway 14).

In the rearward passenger area 7, the watercraft 1 of the present invention has at least one seat configured for accommodating at least one rider. In the preferred embodiment shown in FIG. 1, a pair of seats 10, 20 are provided in the watercraft 1. In FIG. 1, both of the seats 10, 20 are shown in the driving position 11, 21.

In the preferred embodiment, the driver's seat 10 is sized to accommodate both an average, adult-sized driver and an average, adult-sized rider. Similarly, the passenger's seat 20 is sized to accommodate two average, adult-sized riders. Since each seat may accommodate at least two persons, the seats 10, 20 are referred to as "buddy seats."

It should be noted that, throughout this description, references made to the "passenger's seats" and the "driver's seat" are for purposes of distinguishing the locations of the two seats from one another. The appellation "passenger's seat" and "driver's seat" should not be taken to mean that the driver's seat cannot accommodate a passenger or rider or that the passenger's seat cannot accommodate a driver. To the contrary, passengers and drivers are all considered riders of the watercraft 1 and may be seated in any of the locations suitable for a rider, regardless of his or her designation.

Figure 2:
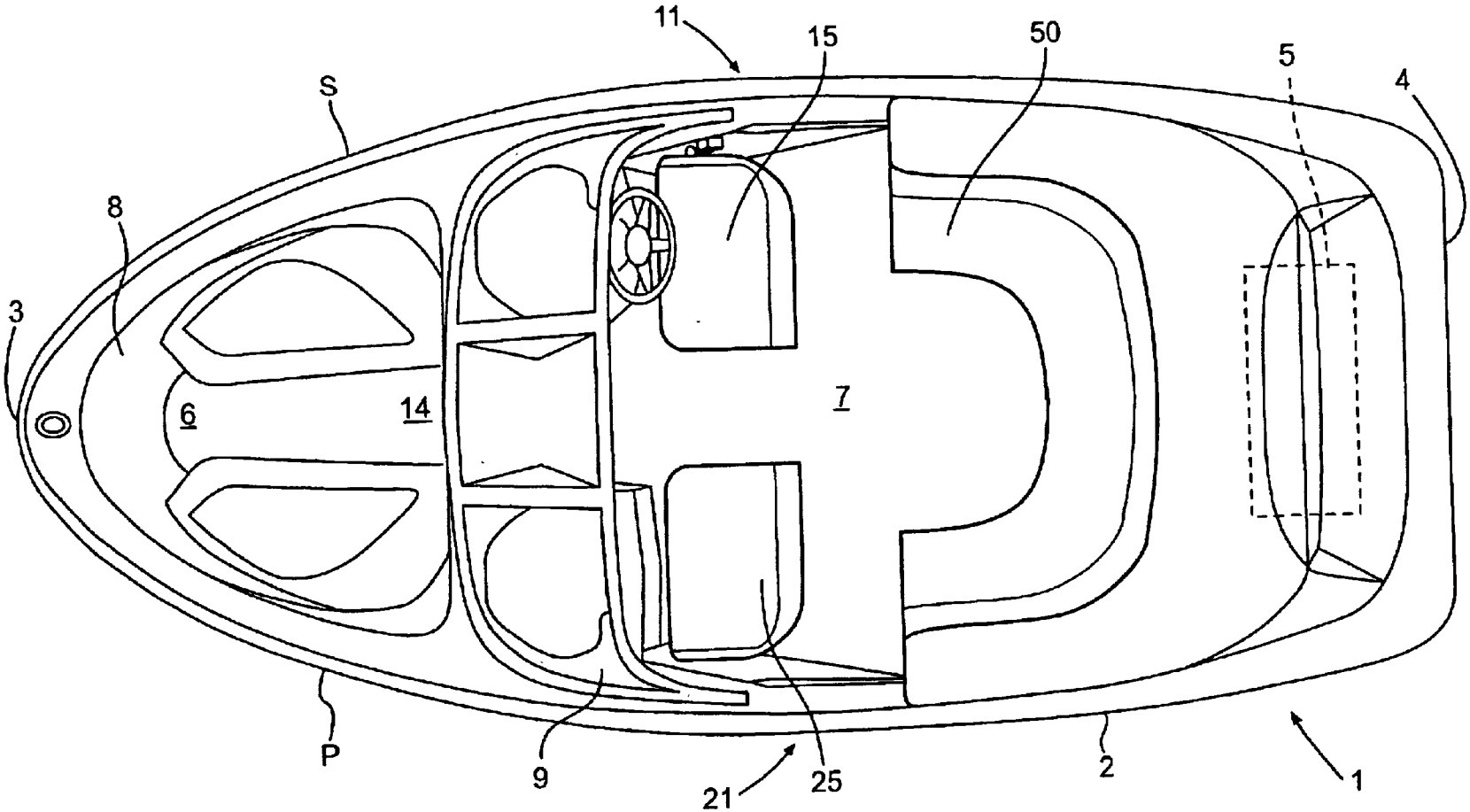
FIG. 2 is a top view of the deck layout of a second embodiment of the watercraft of the present invention with the driver's and passenger's seats in the driving position.

Alternatively, as shown in FIG. 2, the driver's seat 15 may be sized to accommodate a single adult driver and the passenger's seat 25 may be sized to accommodate a single adult rider. One skilled in the art would recognize that any combination of these seats may be possible, i.e., the driver's seat 10, 15 may be sized for a single adult driver and the passenger's seat 20, 25 may be a "buddy seat" or vice-versa. Two of these alternate arrangements are illustrated in FIGS. 8 and 9.

Figure 8:
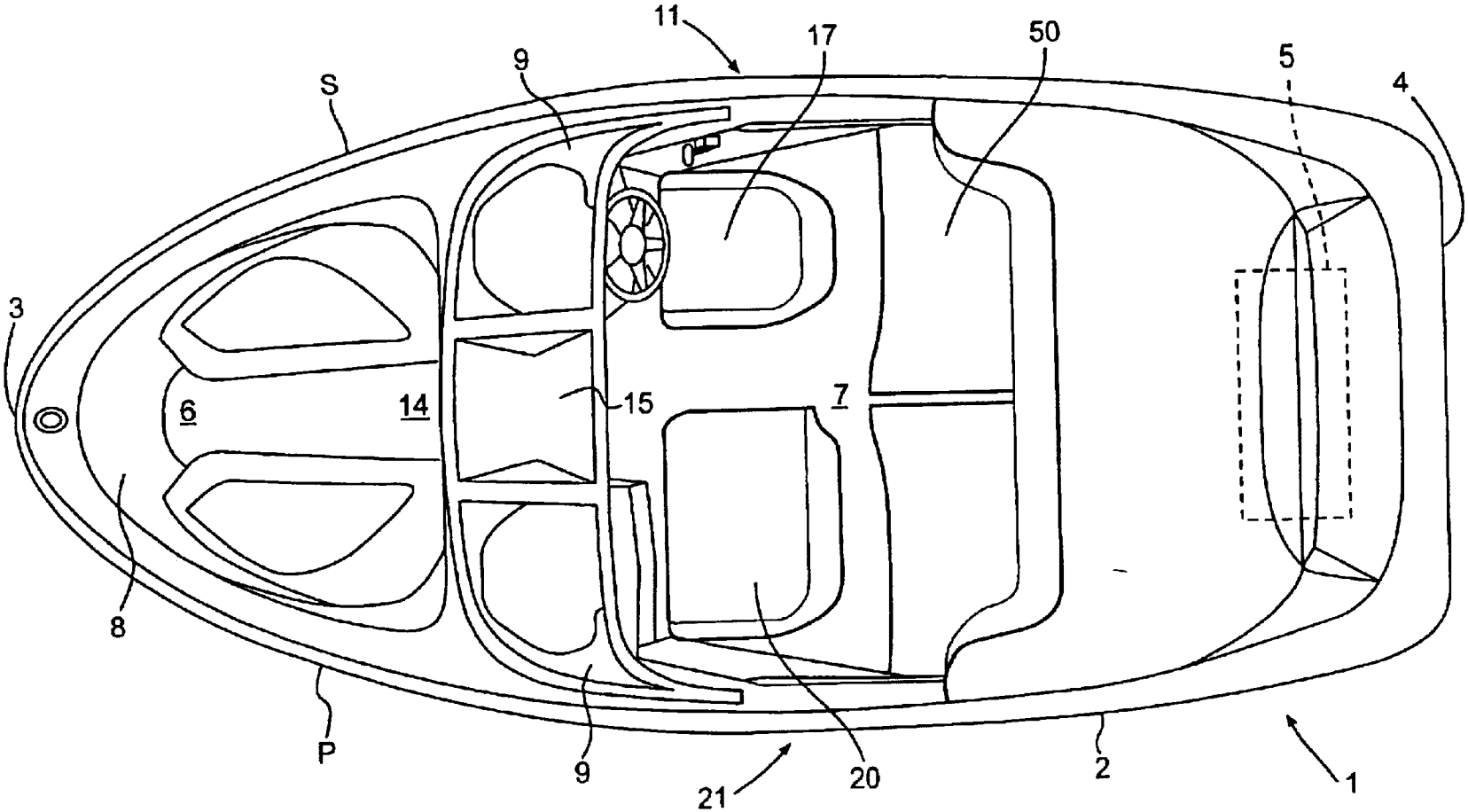
FIG. 8 is a top view of a variation of the deck layout of the first embodiment of the watercraft of the present invention shown in FIG. 1, illustrated with the driver's and passenger's seats in the driving position.
Figure 9:
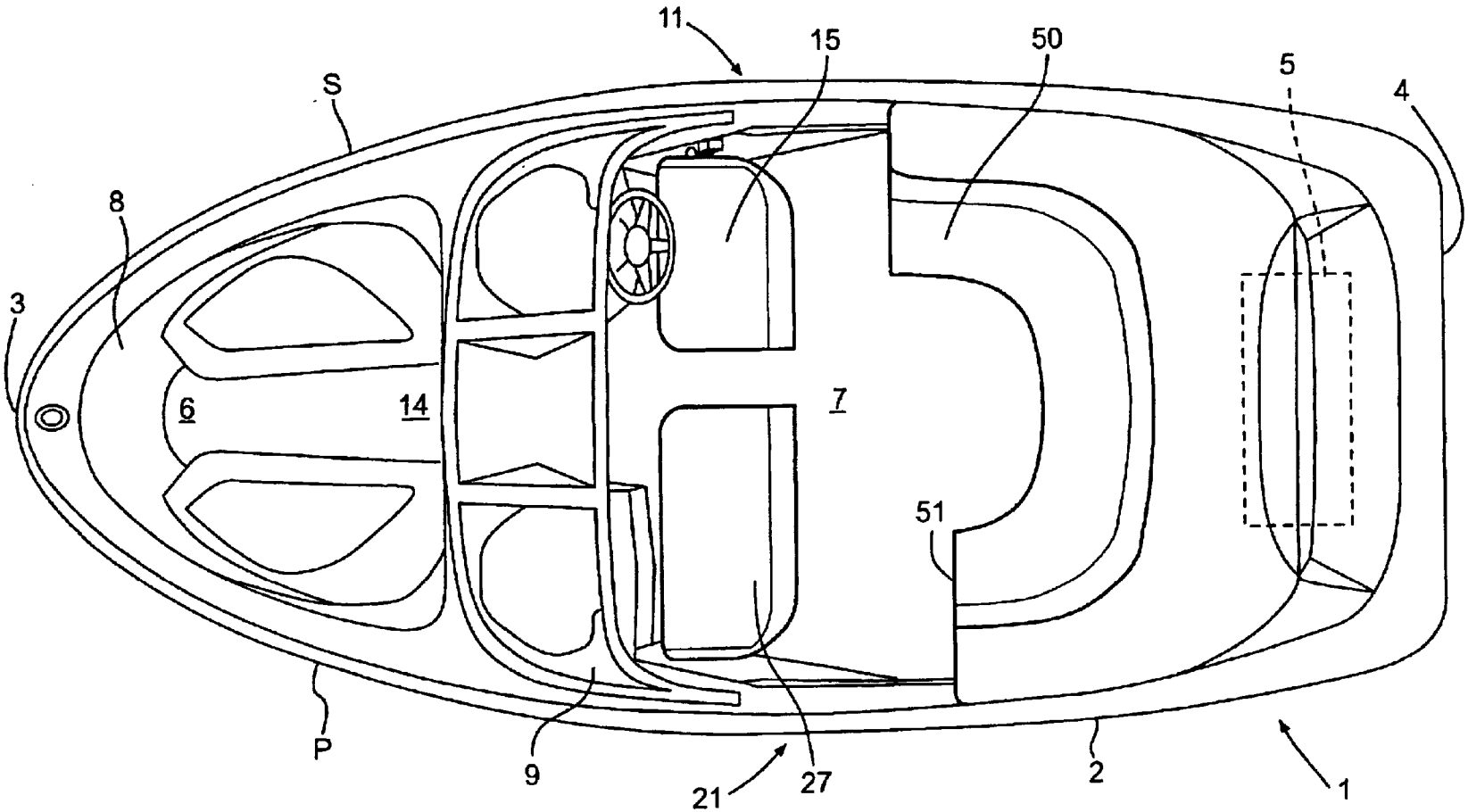
FIG. 9 is a top view of a variation of the deck layout of the second embodiment of the watercraft of the present invention shown in FIG. 2, illustrated with the driver's and passenger's seats in the driving position.

FIG. 8 illustrates a variation of the seating arrangement shown in FIG. 1. In FIG. 8, the passenger's seat 20 is the same as that in FIG. 1. The driver's seat 17, however, is configured to accommodate only one individual rather than two. FIG. 9 illustrates a variation of the seating arrangement shown in FIG. 2. Here, the passenger's seat 27 is configured to accommodate more than one adult person. To accommodate the longer seat 27 when pivoted into the relaxed position (as described in greater detail below), the front edge 51 of the bench seat 50 on the starboard side of the boat is shortened by comparison with the configuration shown in FIG. 2.

Referring again to FIG. 1, the driver's seat 10 and the passenger's seat 20 are both "buddy seats" and form a substantially contiguous seating area while in the driving position 11, 21. Preferably, the inside edges of the driver's seat 10 and passenger's seat 20 are within about 3 inches from one another when the seats 10, 20 are in the driving position 11, 21. Most preferably, the inside edge of the driver's seat 10 and the inside edge of the passenger's seat 20 are within about one inch from one another when the "buddy seats" 10, 20 are in the driving position 11, 21.

As would be appreciated by those skilled in the art, the closeness of the inside edge of the driver's seat 10 to the inside edge of the passenger's seat 20 is not required to practice the present invention. In a boat wider than the one illustrated in FIG. 1, it is possible, perhaps even likely, that the two seats 10, 20 may be separated from one another by a distance greater than 3 inches. Such a separation is considered to be within the scope of the present invention.

Additionally, in instances where the driver's seat 10 or the passenger's seat 20 are designed to accommodate only one adult-sized rider, it is contemplated that the driver's seat 10 and the passenger's seat 20 will be separated from one another by a distance greater than 3 inches. Two such exemplary configurations are illustrated in FIGS. 8 and 9.

Figure 3:
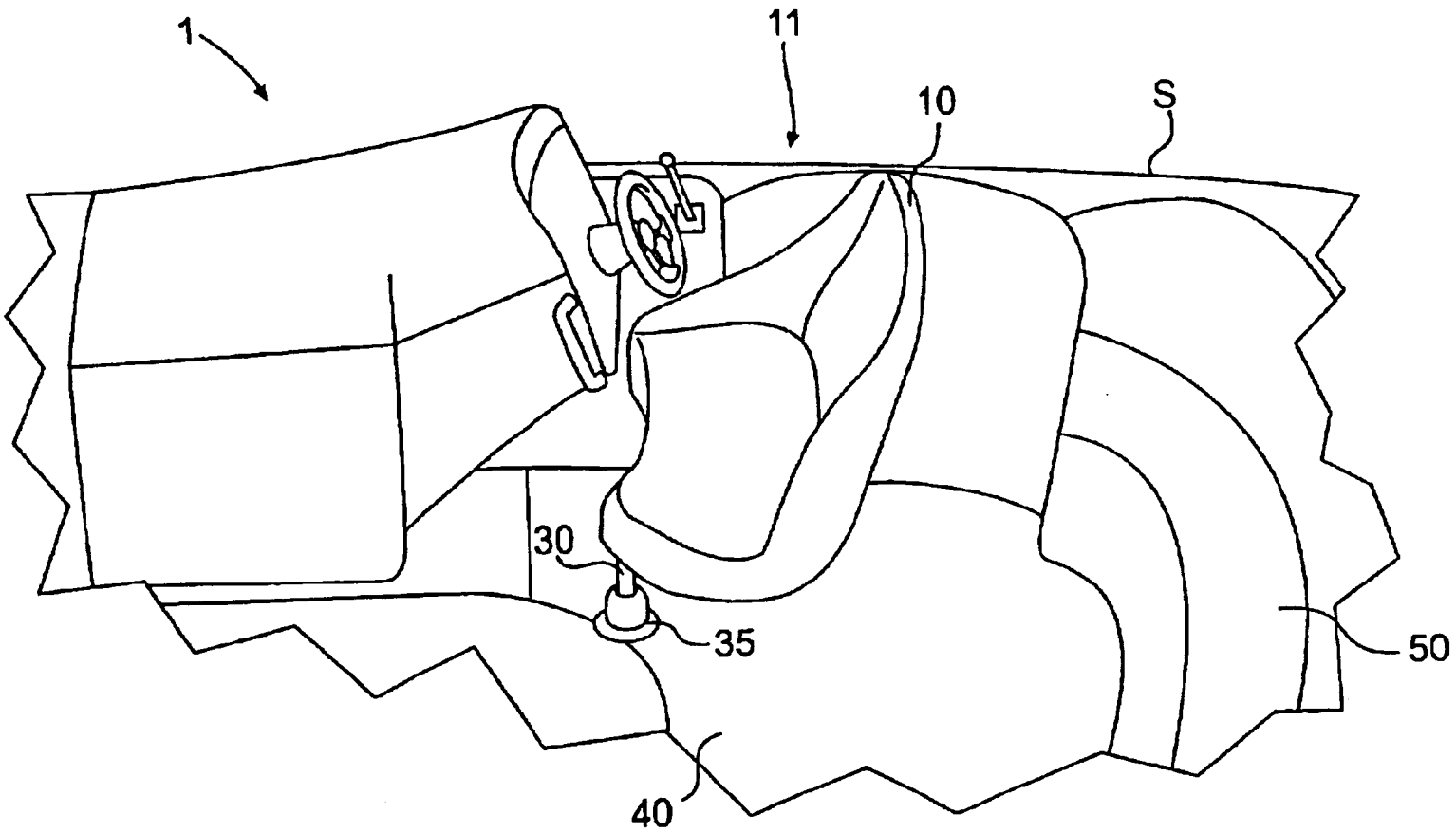
FIG. 3 is a partial perspective view of the driver's seat in the driving position.

In the embodiment illustrated in FIG. 3, the driver's seat 10 is mounted on a swivel mount 30, which permits the driver's seat to rotate about the axis of the swivel mount 30. The swivel mount 30 is attached to a pedestal stop 35. The pedestal stop 35 is used to lock the driver's seat 10 in the desired position. The pedestal stop 35 is mounted to the floor 40 of the watercraft 1. The passenger's seat 20 is mounted to the floor 40 of the watercraft 1 in the same way (not shown) to permit the passenger's seat 20 to swivel about the swivel mount 30.

Figure 4:
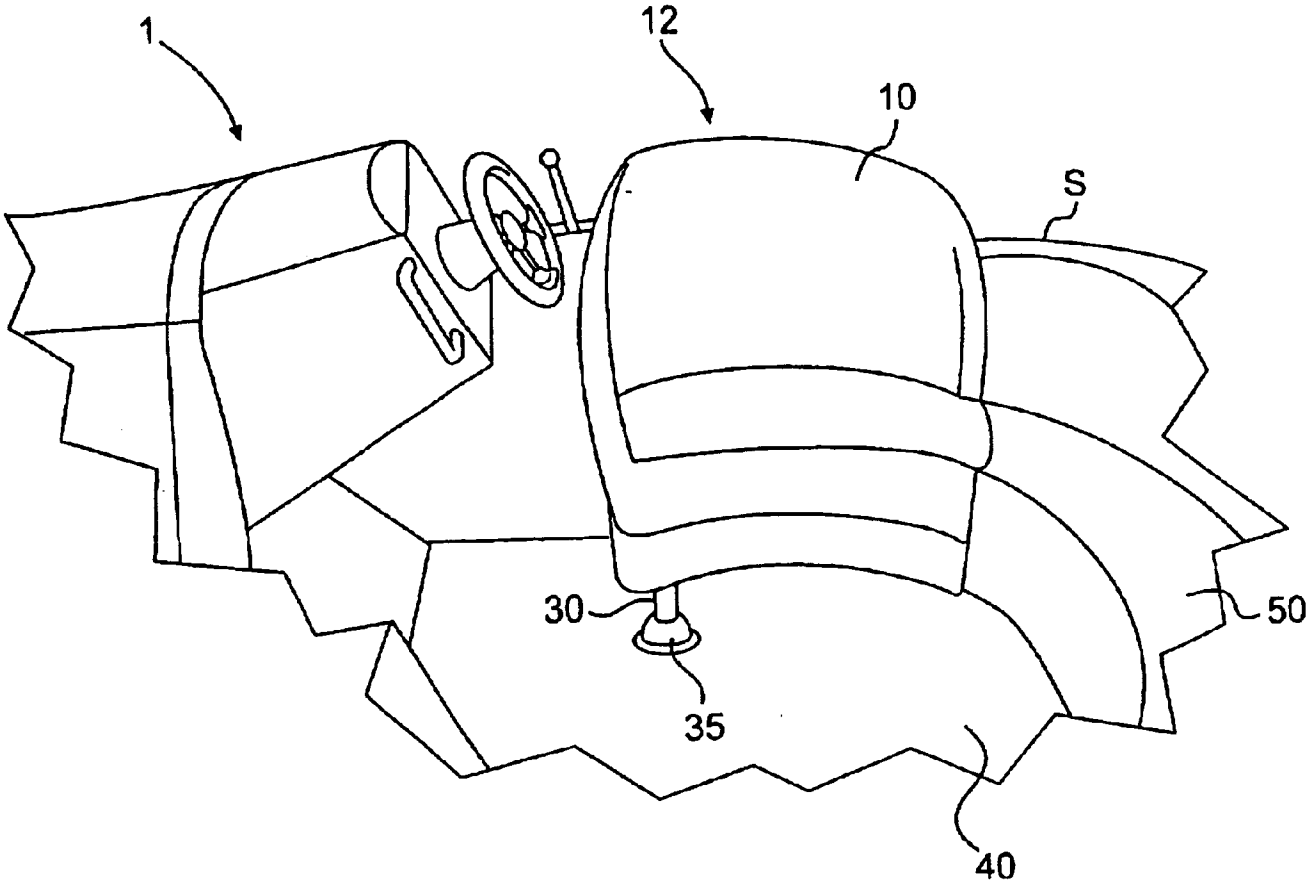
FIG. 4 is a partial perspective view of the driver's seat illustrated in FIG. 3, with the drivers seat reoriented into a relaxing position.

When in the driving position 11, the driver's seat 10 orients the driver of the watercraft 1 in a forward-facing position (toward the bow 3), which is a proper position for driving, as shown in FIG. 3. To change the position of the driver's seat 10, the pedestal stop 35 may be released and the driver's seat 10 may be rotated to a relaxing position 12 and locked in place, as shown in FIG. 4.

The pedestal stop 35 may be of any construction suitable for permitting the driver's seat 10 to pivot from the driving position 11 to the relaxing position 12 and from the relaxing position 12 to the driving position 11. In addition, the pedestal stop 35 may also be equipped with a slide mechanism beneath the seat's bottom portion (not shown) so that the driver may move the driver's seat 10 forwardly or rearwardly (with respect to the swivel mount 30) to accommodate his or her height and comfort requirements (among other requirements). Alternatively, the pedestal stop 35 may be positioned in the center of the driver's seat 10 without a slide mechanism to permit rotation. One skilled in the art would understand that the passenger's seat 20 may be configured as a mirror image of the driver's seat 10.

The "buddy seats" 10, 20 may be rotated from about 0° to about 180° from the driving position 11, 21 to the relaxing position 12, 22. Preferably, the "buddy seats" 10, 20 are rotated from about 90° to about 180° from the driving position 11, 21 to the relaxing position 12, 22. Most preferably, the "buddy seats" 10, 20 are rotated about 90° from the driving position 11, 21 to the relaxing position 12, 22, so that they can be retracted against the side gunwales of the watercraft 1 as shown in FIGS. 4 and 5.

In the preferred embodiment, disposed rearwardly from the "buddy seats" 10, 20 is a passenger bench 50. Preferably, when the "buddy seats" 10, 20 are rotated about 90° from the driving position 11, 21 to the relaxing position 12, 22, the "buddy seats" 10, 20 and the rear passenger bench 50 create a substantially contiguous seating module, as shown in FIG. 5. Preferably, the gap between the "buddy seats" 10, 20 and the rear passenger bench 50 is less than about 3 inches when the "buddy seats" are in the relaxing position 12, 22. Most preferably, the gap between the "buddy seats" 10, 20 and the rear passenger bench 50 is less than about 1 inch when the "buddy seats" are in the relaxing position 12, 22. In an alternate arrangement, which is contemplated for a longer watercraft than the one illustrated in FIG. 5, leg room could be provided between the buddy seats 10, 20 and passenger bench 50 when the buddy seats 10, 20 have been rotated to the relaxing position 12, 22.

Figure 5:
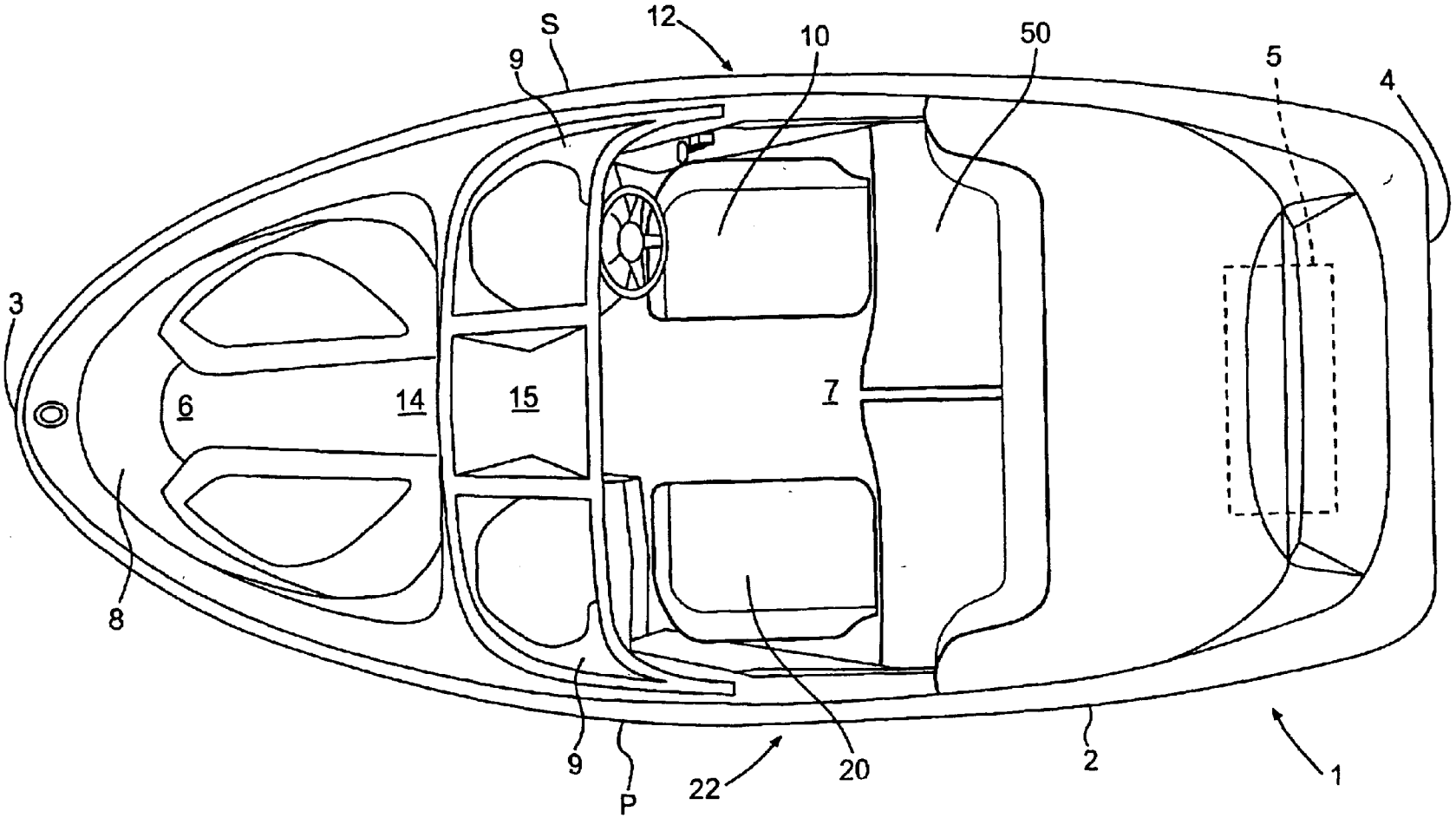
FIG. 5 is a top view of the deck layout of the first embodiment of the watercraft of the present invention with the driver's and passenger's seats in a first relaxing position.

Alternatively, the "buddy seats" 10, 20 may be rotated about 90° from the driving position 11, 21 to the relaxed position 12, 22, but the "buddy seats" 10, 20 do not form a substantially contiguous seating module as illustrated in FIG. 5. Instead, there may exist a gap (not shown) between the "buddy seats" and the rear passenger bench 50. This is likely if the watercraft 1 is longer than the embodiment illustrated in FIG. 5. This is also likely if one of the seats has a single-passenger configuration as shown in FIG. 8.

Figure 6:
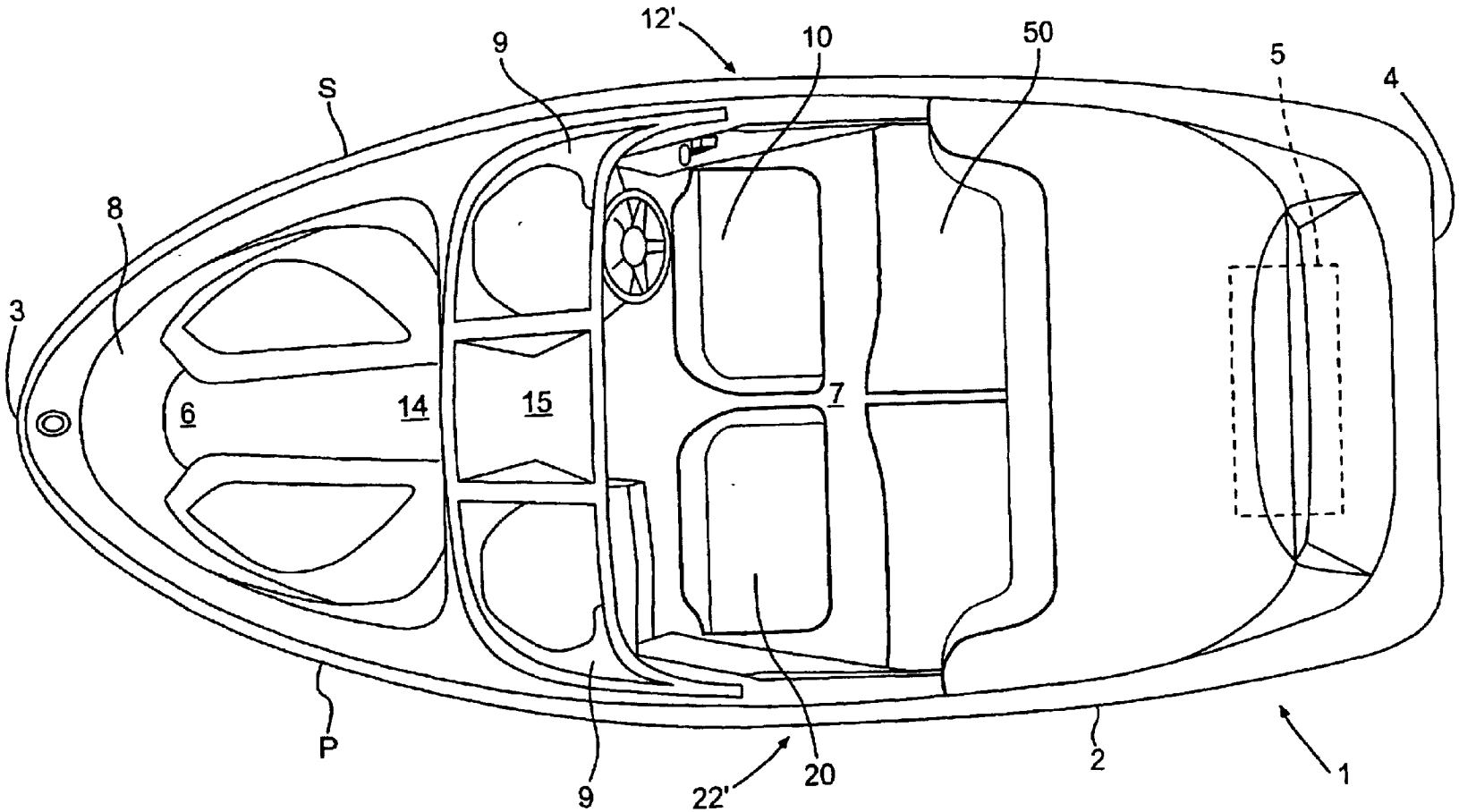
FIG. 6 is a top view of the deck layout of the first embodiment of the watercraft of the present invention with the driver's and passenger's seats in a second relaxing position.

In still another alternative embodiment, the "buddy seats" 10, 20 may be rotated about 180° from the driving position 11, 21 to an alternative relaxing position 12', 22' so that they face the rear passenger bench 50, as illustrated in FIG. 6. To permit the seats 10, 20 to rotate 180°, the seats may have to be placed in a boat wider (and perhaps longer) than the one illustrated. Alternatively, the seats 10, 20 may be provided with a support that permits both rotation and sliding (sideways movement) to facilitate rotation of the seats 10, 20 a fill 180°, as illustrated in FIG. 6.

Figure 7:
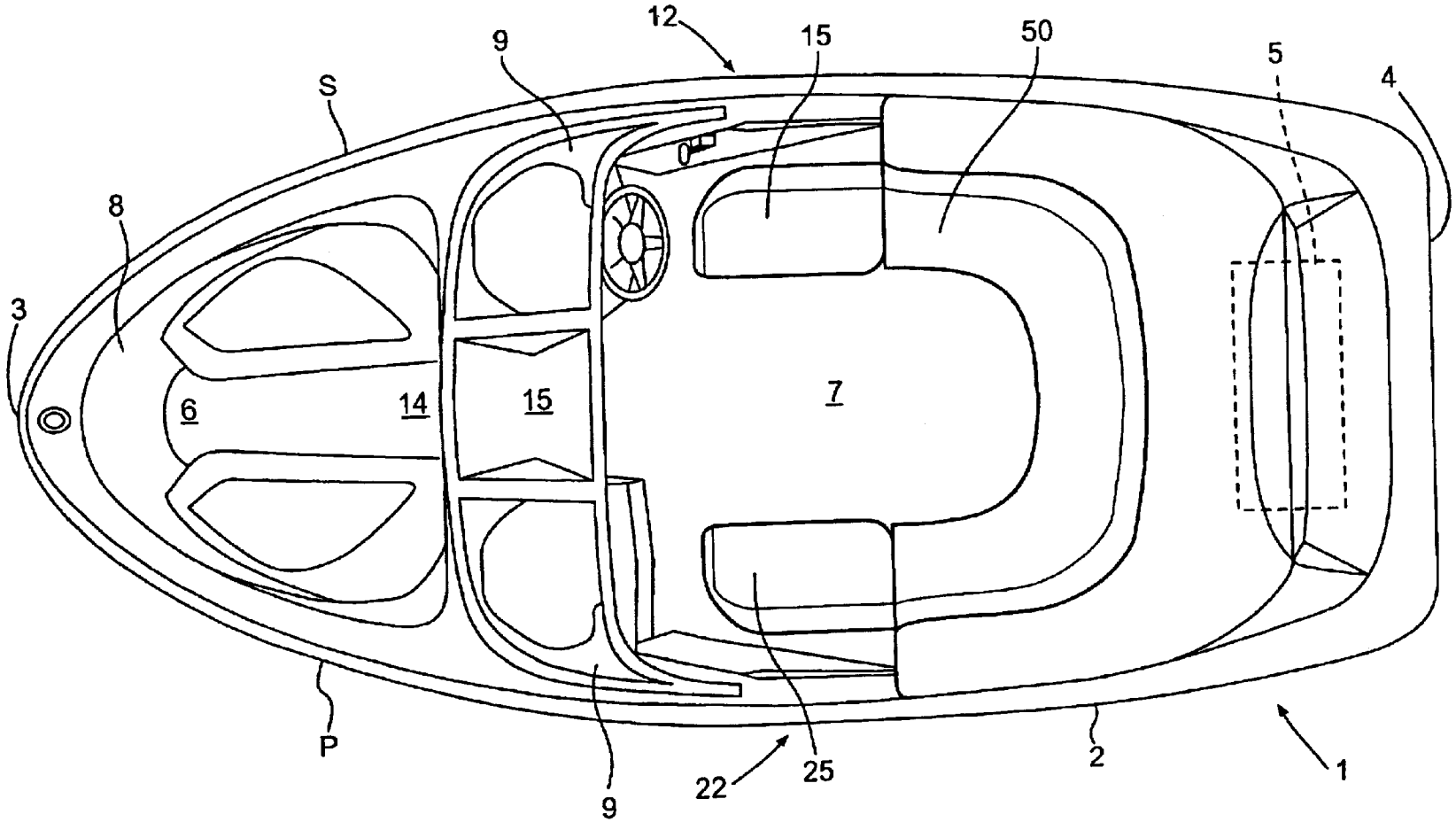
FIG. 7 is a top view of the deck layout of the second embodiment of the watercraft of the present invention with the driver's and passenger's seats in the first relaxing position.

The passenger bench 50 can be of any design known to one skilled in the art. The bench 50 may be, but is not limited to, a substantially straight design, as illustrated in FIG. 5, or a curved design, as illustrated in FIG. 7. One skilled in the art would understand that the rear passenger bench 50 may be designed such that the "buddy seats" 10, 20 will form a substantially contiguous seat module once the "buddy seats" 10, 20 are in the relaxing position 12, 22, as shown in FIG. 5. One skilled in the art would also understand that if the driver's seat 15 and passenger's seat 25 are designed to accommodate only one person each, the rear passenger bench 50 may be designed such that a substantially contiguous seating module is formed, once the seats 15, 25 are in the relaxing position 12, 22, as illustrated in FIG. 7.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A watercraft, comprising:

a hull;

a first seat affixed to the hull and configured for accommodating a driver and at least one rider, wherein the first seat is selectively switchable between a driving position and at least one relaxing position;

a second seat affixed to the hull and configured for accommodating at least two riders, wherein the second seat is selectively switchable between the driving position and the at least one relaxing position;

at least one swivel mount, wherein one of the first and second seats pivot about the at least one swivel mount when being selectively switched between the driving position and the at least one relaxing position; and a passenger bench disposed rearwardly from the first seat and the second seat, wherein, when the first seat and the second seat are in the relaxing position, the first seat, the passenger bench and the second seat form a substantially contiguous seating module.

2. watercraft, comprising:

a hull;

a first seat affixed to the hull and configured for accommodating a drver and at least one rider, wherein the first seat is selectively switchable between a driving position and at least one relaxing position;

a second seat affixed to the hull and configured for accommodating at least two riders, wherein the second seat is selectively switchable between the driving position and the at least one relaxing position; such that, when the first seat and the second seat are in the driving position, the first seat and the second seat are substantially contiguous; and at least one swivel mount, wherein one of the first and second seats pivot about the at least one swivel mount when being selectively switched between the driving position and the at least one relaxing position.

3. A watercraft, comprising:

a hull;

a first seat affixed to the hull and configured for accommodating a driver and at least one rider, wherein the first seat is selectively switchable between a driving position and at least one relaxing position;

a second seat affixed to the hull and configured for accommodating at least two riders, wherein the second seat is selectively switchable between the driving position and the at least one relaxing position;

a first swivel mount, wherein one of the first and second seats pivot about the first swivel mount when being selectively switched between the driving position and the at least one relaxing position; and a second swivel mount, wherein the remaining one of the first seat and second seat pivots about the second swivel mount when being selectively switched between the driving position and the relaxing position.

4. A watercraft according to claim 1, wherein, when the first seat and the second seat are in the relaxing position, the first seat and the second seat are disposed from about 90° to about 180° from the driving position.

5. A watercraft according to claim 4, wherein, when the first seat and the second seat are in the relaxing position, the first seat and the second seat are disposed about 90° from the driving position.

6. A watercraft, comprising:

a hull;

a seat affixed to the hull and configured for accommodating a rider, wherein the seat is selectively switchable between a driving position and at least one relaxing position;

a passenger bench affixed to the hull and disposed rearwardly from the seat, wherein when the seat is in the relaxing position, the seat and the passenger bench form a substantially contiguous seating module; and a swivel mount, wherein the seat pivots about the swivel mount when being selectively switched between the driving position and the relaxing position.

7. A watercraft according to claim 6, wherein, when the seat is in the relaxing position, the seat is disposed about 90° from the driving position.

8. A water-craft according to claim 6, further comprising:

a second seat affixed to the hull and configured for accommodating at least two riders.

9. A watercraft, comprising:

a hull;

a first seat affixed to the hull and configured for accommodating a rider, wherein the first seat is selectively switchable between a driving position and at least one relaxing position;

a second seat affixed to the hull and configured for accommodating a rider, wherein the second seat is selectively switchable between the driving position and at least one relaxing position; and a passenger bench affixed to the hull and disposed rearwardly from the first seat and the second seat, wherein when the first seat and the second seat are in the relaxing position, the first seat, the passenger bench and the second seat form a substantially contiguous seating module.

10. A watercraft according to claim 9, further comprising a first swivel mount and a second swivel mount, wherein the first seat pivots about the first swivel mount when being selectively switched between the driving position and the relaxing position and the second seat pivots about the second swivel mount when being selectively switched between the driving position and the relaxing position.

11. A watercraft according to claim 9, wherein, when the first seat and the second seat are in the relaxing position, the first seat and the second seat are disposed about 90° from the driving position.

* * * * *